United States Patent [19]

Kunerth et al.

[11] Patent Number: 4,962,656

[45] Date of Patent: Oct. 16, 1990

[54] CONTROL AND MONITORING METHOD AND SYSTEM FOR ELECTROMAGNETIC FORMING PROCESS

[75] Inventors: Dennis C. Kunerth; Gordon D. Lassahn, both of Idaho Falls, Id.

[73] Assignee: The United States of America as represented by the United States Department of Energy, Washington, D.C.

[21] Appl. No.: 373,531

[22] Filed: Jun. 30, 1989

[51] Int. Cl.[5] ..... B21D 26/14

[52] U.S. Cl. ..... 72/56; 72/707; 29/419.2; 29/DIG. 95

[58] Field of Search ..... 72/54, 56, 707; 29/DIG. 95, 419.2; 336/60

[56] References Cited

U.S. PATENT DOCUMENTS

| | | | |
|---|---|---|---|
| 3,126,937 | 3/1964 | Brower | 72/56 |
| 3,256,846 | 6/1966 | Keinanen | 72/56 |
| 3,279,228 | 10/1966 | Brower | 72/56 |
| 3,387,476 | 6/1968 | Karl-Georg Gunther | 72/56 |
| 3,407,637 | 10/1968 | Dietz et al. | 72/56 |
| 3,618,350 | 11/1971 | Larrimer, Jr. et al. | 72/56 |
| 3,823,589 | 7/1974 | Tikhonovich et al. | 72/56 |
| 3,896,647 | 7/1975 | Mikhailov et al. | 72/56 |
| 4,619,127 | 10/1986 | Sano et al. | 72/56 |
| 4,656,918 | 4/1987 | Rose et al. | 72/56 |

FOREIGN PATENT DOCUMENTS

| | | | |
|---|---|---|---|
| 2328969 | 12/1974 | Fed. Rep. of Germany | 72/56 |
| 2609217 | 9/1977 | Fed. Rep. of Germany | 72/56 |
| 0032116 | 2/1984 | Japan | 72/56 |
| 0064125 | 4/1984 | Japan | 72/707 |
| 0115628 | 5/1988 | Japan | 72/707 |
| 1066701 | 1/1984 | U.S.S.R. | 72/707 |

*Primary Examiner*—David Jones

*Attorney, Agent, or Firm*—Mark P. Dvorscak; Paul A. Gottlieb; William R. Moser

[57] ABSTRACT

A process, system, and improvement for a process for electromagnetic forming of a workpiece in which characteristics of the workpiece such as its geometry, electrical conductivity, quality, and magnetic permeability can be determined by monitoring the current and voltage in the workcoil. In an electromagnet forming process in which a power supply provides current to a workcoil and the electromagnetic field produced by the workcoil acts to form the workpiece, the dynamic interaction of the electromagnetic fields produced by the workcoil with the geometry, electrical conductivity, and magnetic permeability of the workpiece, provides information pertinent to the physical condition of the workpiece that is available for determination of quality and process control. This information can be obtained by deriving in real time the first several time derivatives of the current and voltage in the workcoil. In addition, the process can be extended by injecting test signals into the workcoil during the electromagnetic forming and monitoring the response to the test signals in the workcoil.

18 Claims, 3 Drawing Sheets

C (N) Coefficients vs Tube Radius

CONTROL AND MONITORING METHOD AND SYSTEM FOR ELECTROMAGNETIC FORMING PROCESS

CONTRACTUAL ORIGIN OF THE INVENTION

The United States Government has rights in this invention pursuant to Contract No. DE-AC07-76ID01570 between the United States Department of Energy and EG&G Idaho, Inc.

BACKGROUND OF THE INVENTION

The present invention is related to electromagnetic forming of metals, such as iron, steel, and aluminum. In particular, the present invention is related to monitoring and control of the electromagnetic forming process.

Electromagnetic forming is a process for shaping a metal product (called the workpiece) by means of the application of electromagnetic forces. Electromagnetic forming relies on the interaction of the magnetic field with the metal of the workpiece. The electromagnetic field is produced by passing an time varying electric current through a coil (called the workcoil). The current in the workcoil can be provided by the discharge of a capacitor (or more typically by a bank of capacitors) resulting in a pulsed output. The workpiece can be maintained at a temperature so that it is somewhat malleable to aid the forming process, although this is not necessary.

The electromagnetic forming process has several clear advantages. For example, there is no frictional contact between the workpiece and the field thereby allowing for a high quality finish on the workpiece. Also, the pulsed application of the electromagnetic field to the workpiece can be readily adapted to an automated "assembly line"-type process. Another advantage is that electromagnetic forming can be adapted to shapes for which it would be difficult to apply a solid mold wall.

Electromagnetic forming processes can typically have several different configurations. In one configuration, the workpiece surrounds the workcoil so the action of the field tends to expand or bulge the workpiece. In another configuration, the workcoil and workpiece are adjacent to each other so that the field bends the workpiece away from the workcoil. Another configuration has the workcoil surrounding the workpiece so that the field compresses the workpiece. In an example of this latter configuration, electromagnetic forming can be used to compress bands of metal on cylindrical-shaped molds.

Several factors limit the utility of the electromagnetic forming process. For example, since a relatively large electromagnetic pulse is necessary to form the metal, the coils and capacitors must be designed to accommodate such a pulse. Arcing of current across the turns of the workcoil or burnup of the capacitor can occur. Also, the coils and capacitors that are used may not be so precisely designed to produce a consistent electromagnetic force each time. Furthermore, other factors that can affect the amount of force applied to the workpiece include the temperature, thickness, and composition of the workpiece itself. It is for reasons such as these that electromagnetic forming has been used primarily in relatively simple applications with thin workpieces where solid molds can be used to define a boundary or otherwise limit application of the electromagnetic force.

It would enhance the utility of the electromagnetic forming process to be able to precisely control the application of the force of the electromagnetic field to the workpiece. However, even if greater control of the electromagnetic force produced by the workcoil were provided, the effect of the field on the workpiece is affected by factors related to the workpiece itself, such as composition, temperature, and dimensions of the workpiece. Therefore, in order to provide a electromagnetic forming process with a high degree of precision, it is necessary not only to precisely control the workcoil, but it is also necessary to be able to monitor the effects of the electromagnetic force on the workpiece during the application of the electromagnetic field to the workpiece. Such monitoring would be very advantageous to the electromagnetic forming process and would enable forming pieces of larger sizes and more complex shapes.

Inherent to all electromagnetic forming processes are electromagnetic fields which interact with the workpiece to provide a force which holds or shapes the work piece in some desired fashion. Contributions to the working electromagnetic field come from both the driving primary current source (workcoil) and the eddy currents induced in the workpiece. As a result, information regarding the instantaneous condition of the workpiece and the driving electronics are incorporated into the field in the form of amplitude, phase, and frequency. This information can be extracted using various electronic means and used to actively monitor or control the progress of the electromagnetic forming process.

In all processing techniques that use electromagnetic fields to physically form a solid or liquid metallic material, the electromagnetic fields contain the responses of the material to dynamic changes in the geometry, electrical conductivity, and magnetic permeability of the material during the processing. Therefore, monitoring the electromagnetic fields can provide information on the physical condition of the material being processed as well as the dynamics of the process itself. By directly monitoring the process via inherent or externally injected electromagnetic fields, means can be provided to actively monitor physical and metallurgical characteristics of the product such as geometry, cracking, temperature, and phase formation. This permits determination of the finished product's quality without the need for subsequent characterization or inspection steps, as well as providing information which can potentially be used to control the process in real time. Active process control may allow fabrication of products with increased physical and microstructural complexity.

Accordingly, it is an object of this invention to provide a monitoring and process control technique for electromagnetic forming processes based on the measurable interactions between the working electromagnetic fields and the material being processed.

It is another object of this invention is to use the electromagnetic fields inherent to electromagnetic forming techniques for the purpose of in-process control and monitoring.

Another object of this invention is to use the information contained in the responses of a workpiece to the field applied by the electromagnetic workcoil for monitoring of processes variables such as workpiece shape, temperature, defect formation, and phase change.

A further object of this invention is to provide a basis for feedback control algorithms for active control of electromagnetic forging which would permit dynamic control of force application and three dimensional displacement.

A yet further object of this invention is to provide the ability to control electromagnetic forming phenomena in real time to enhance the efficiency and capabilities of the electromagnetic forming technology.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objectives and in accordance with the purposes of the present invention, as embodied and broadly described herein, the present invention provides for a process, a system, and an improvement of a process for electromagnetic forming of a workpiece in which characteristics of the workpiece such as its geometry, electrical conductivity, quality, and magnetic permeability can be determined by monitoring the current and voltage in the workcoil. In an electromagnetic forming process in which a power supply provides current to a workcoil and the electromagnetic field produced by the workcoil acts to form the workpiece, the dynamic interaction of the electromagnetic field produced by the workcoil with the geometry, electrical conductivity, and magnetic permeability of the workpiece, provides information pertinent to the physical condition of the workpiece that is available for determination of quality and process control. This information can be obtained by deriving in real time the first several time derivatives of the current and voltage in the workcoil. In addition, the process can be extended by injecting test signals into the workcoil during the electromagnetic forming and monitoring the response to the test signals in the workcoil.

DETAILED DESCRIPTION OF THE INVENTION

Magnetic forming is a process in which an electrically conducting metal part (the workpiece) is shaped by the use of a short pulsed magnetic field generated by an electromagnet. The present invention includes means for monitoring the current and voltage of the electromagnet to provide information of the progress of the forming process. With the information so obtained, the quality and finish of the final product can be determined without subsequent inspection and further the electromagnetic forming process can be controlled to yield products of higher quality or more complexity and at less cost. For example, in an electromagnetic forming process in which the workcoil surrounds the workpiece (such as a tube), the present invention will provide information to determine whether the tube has shrunk the desired mount by measuring the electrical characteristics of the workcoil.

Figure 1:
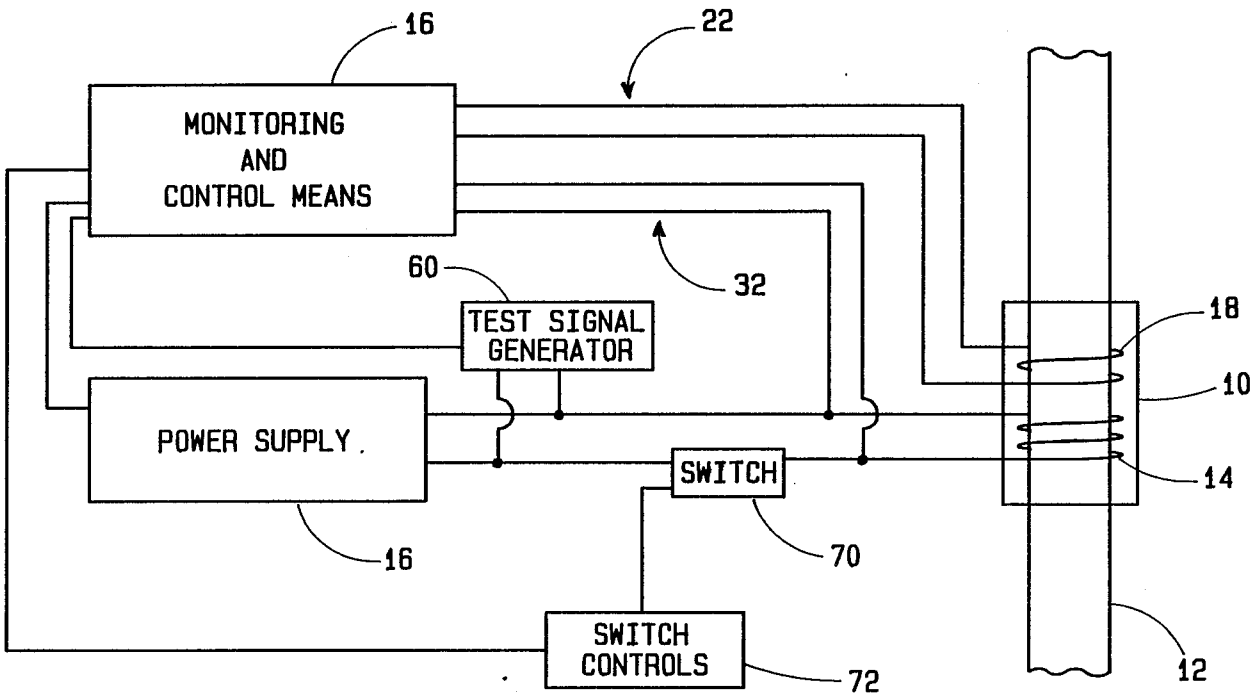
FIG. 1 is a diagram of the electromagnetic forming process including the present invention.

Referring to FIG. 1, coil unit 10 surrounds a workpiece 12. Coil unit 10 includes workcoil 14 (also referred as driver coil). As depicted in FIG. 1, workpiece 12 is a metal tube. In a typical application, power supply 16 provides a short current pulse through the workcoil 14 causing the workpiece 12 to collapse or shrink radially. Coil unit 10 also includes sensing coil 18 which is located proximate to working coil 14. Sensing coil 18 is coupled to monitoring and control means 16.

Figure 2:
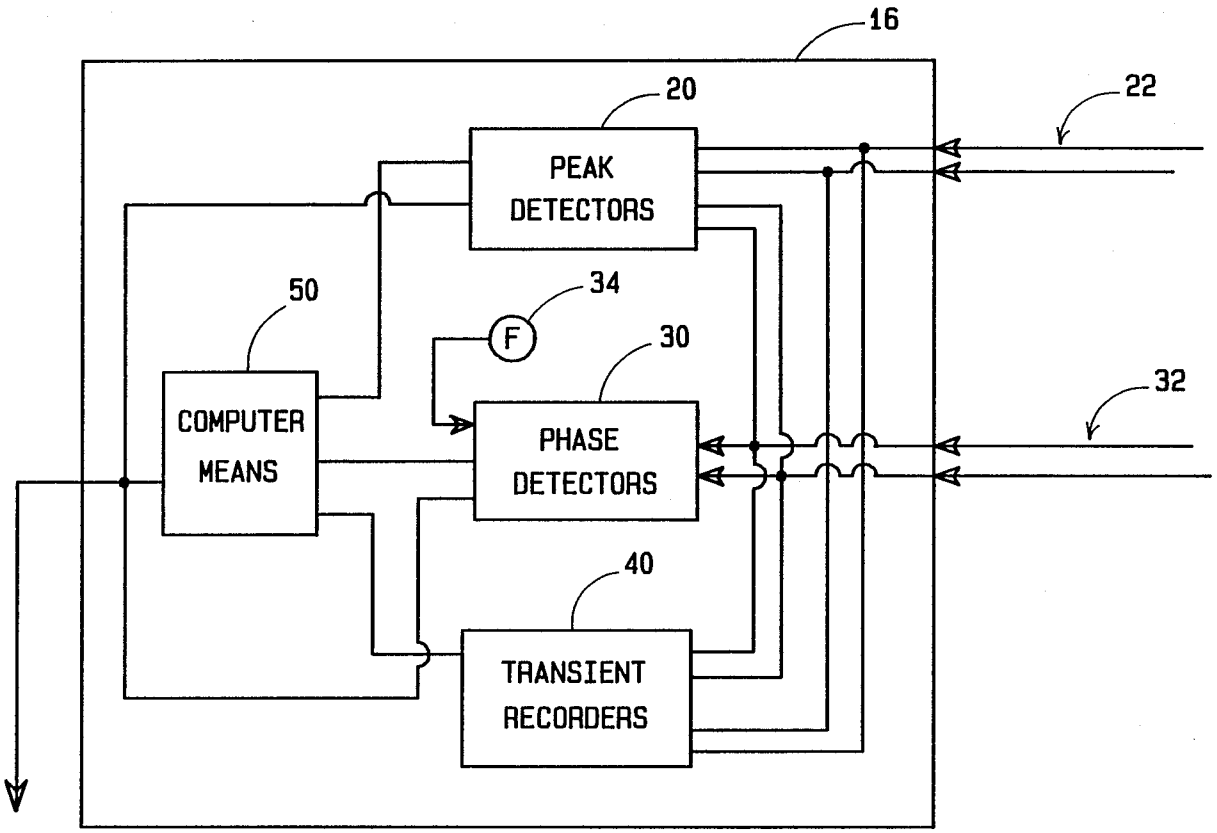
FIG. 2 is a diagram of the monitoring and control means that forms a part of the present invention.

Referring to FIG. 2, there are depicted components that make up the monitoring and control means 16. A peak detector 20 is coupled to sensing coil 18 by connection 22. Peak detector 20 measures the voltage in the coil unit 10. Phase detector 30 is coupled to the working coil 14 by connection 32. A frequency reference 34 provides a reference for the phase detector 30. Transient recorders 40 are connected to the sensing coil connection 22, the work coil connection 32, and the peak detector 20. A computer control means (CPU) 50 receives input from the peak detector 20, the phase detector 30, and the transient recorders 40. Computer control means 50 can be programmed to record the signals from the peak detector 20, the phase detector 30, and the transient recorders 40 and exercise control over the electromagnetic forming process in accordance with the method described herein.

The monitoring and control means 16 (specifically, the computer control means 50 operating upon the input of the peak detector 20, the phase detector 30, and the transient recorders 40) measures, in real time, both the current and the voltage in the coil unit 10. Monitoring and control means 16 also derives, essentially in real time, the first few time derivatives of the current, either by analog or digital means. An indication of the progress of the forming process can be provided from the relationship between the voltage and the current derivatives. Specifically, in the example considered here, the radius of the collapsing tube 12 can be determined from the measured parameters of the coil unit 10.

The workcoil voltage can be considered as being generated by the current in a series of steps, each step making a contribution to the voltage. The N-th step, giving the N-th contribution to the total voltage, depends on the N-th time derivative of the coil current and on the configuration of the system (the workcoil and the workpiece). The voltage contribution for $N=0$ is simply the current (the 0-th derivative of the current) multiplied by the coil resistance. The $N=1$ contribution is the first derivative of the current multiplied by the coil's self inductance. Both of these first two voltage contributions depend only on the drive coil characteristics which are constant and can be measured easily, i.e. they are not affected by the tube.

The current in the coil induces a voltage in the tube, proportional to the first derivative of the coil current. It also induces a voltage in the coil itself which gives rise the just-mentioned self-inductance. If the tube is electrically conductive, this induced voltage will cause current to flow in the tube. This current induces a voltage in the coil, proportional to the first derivative of the tube current and hence to the second derivative of the coil current. Thus, there is an $N=2$ coil voltage component that is proportional to the second derivative of the coil current, with the proportionality depending on the electrical and geometrical properties of the tube. This enables the determination of the tube radius by monitoring the workcoil voltage.

There are an infinite number of additional voltage contributions in this system. The N=3 component, for example, arises in the following manner: The coil current induces a voltage and hence a current in the tube; call this the N=2 tube current. This N=2 tube current induces another voltage and hence another current component, the N=3 current component, in the tube. This N=3 tube current induces the N=3 voltage component in the coil, proportional to the third derivative of the coil current. Furthermore, the N=3 tube current component induces an N=4 coil voltage component proportional to the fourth derivative of the coil current. This process goes on forever. However, the successive voltage contributions become smaller and smaller. A quantitative analysis provides a basis for the convergence of this series and the practical utility of this approach.

For the quantitative analysis, view the system in cylindrical coordinates with the z-axis along the tube axis and z=0 at the coil center. The analysis is done numerically, so one divides the r-z plane into small cells, each cell being small compared to the r and z dimensions of the coil and the tube. Thus, each cell represents a toroid of rectangular cross section, the toroid being small in the r and z directions but filling the entire $2\pi$ range of the angle coordinate. Let $r_i$=the r-coordinate of cell i,j $z_j$=the z-coordinate of cell i,j $M_{ij,kl}$=the mutual inductance of the two circuit elements comprising cell i,j and cell k,l, and C(N)=the coefficient relating the N-th coil voltage component to the N-th derivative of the current.

The total voltage V is given by $$V = \Sigma_N C(N) \frac{d^N I}{dt^N}$$

where I is the coil current, and t is time. C(0) is not calculated in this analysis; it is simply the coil resistance, which is presumed known from measurement. C(1) would not normally be calculated, but it is instructive to see the form that the calculation would take, and the calculation serves as a check on the calculation algorithms. The equation for C(1) is $$C(1)=A\ \Sigma_{i,j}\ \Sigma_{a,b}\ M_{i,j\ a,b}\ dr_a\ dz_b,$$

where dr and dz are the r and z dimensions of the cell, the sums are both taken over all cells in the driver coil, and $$A = \frac{\dfrac{(\text{number of turns in coil})^2}{(\text{coil area in } r\ z \text{ plane})}}{(\text{number of cells in coil})}$$

The equations for the other C coefficients follow a pattern which is easily discerned from inspection of the next two equations:

$$C(2) = A\ \Sigma_{i,j}\ \Sigma_{k,l}\ M_{ijkl}\ dr_k\ dz_l\ (S/r_k)\ \Sigma_{a,b}\ M_{klab}\ dr_a\ dz_b/(-2\pi)$$

$$C(3) = A\ \Sigma_{i,j}\ \Sigma_{k,l}\ M_{ijkl}\ dr_k\ dz_l\ (S/r_k)\ \Sigma_{m,n}\ M_{klmn}\ dr_m\ dz_n/(Sr_m)\ \Sigma_{a,b}\ M_{mnab}\ dr_a\ dz_b/(-2\pi)^2$$

where S is the electrical conductivity of the tube material, the sums over i,j,a,b include all cells in the workcoil, and the sums over k,l,m,n include all cells in the tube. These and the analogous higher-order equations allow the numerical calculation of as many C coefficients as desired.

Calculations indicate that the C coefficients decrease rapidly as N increases. However, this does not assure convergence of the sum of the infinite number of voltage components, because the successive time derivatives of the current typically increase rapidly as N increases. A rough estimate of convergence can be made by comparing the ratio of successive C values with the angular frequency of the dominant or representative frequency component of the coil current. If the coil current frequencies are too large (the current pulse is too short), this series cannot be expected to converge quickly and the analytical approach described herein would not apply. On the other hand, for sufficiently slow current pulses, this series converges very quickly, and it may be sufficient to use only a few terms to accurately describe the process.

Figure 3:
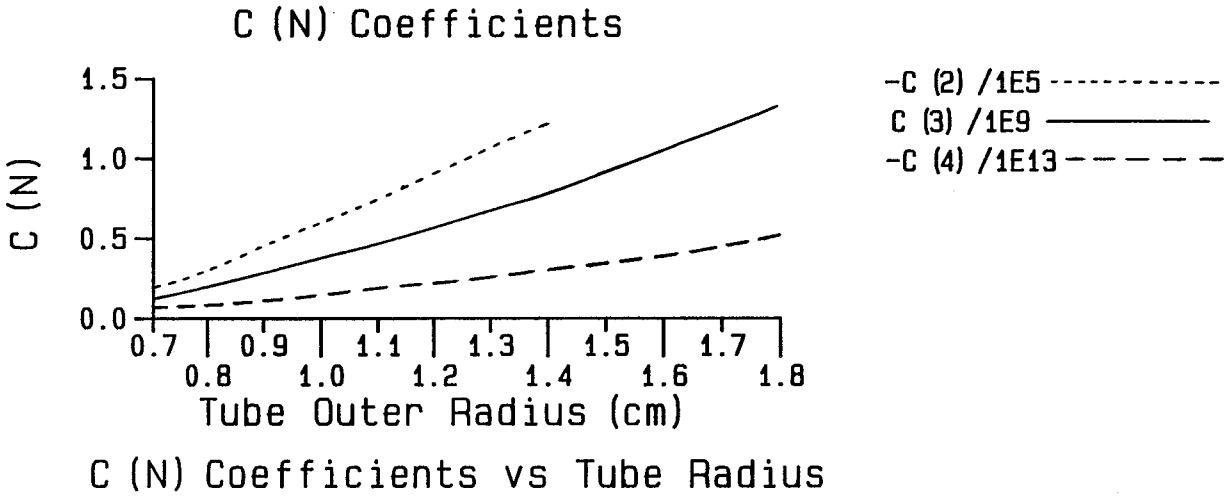
FIG. 3 is a graph of the coefficient C(N) relating the N-th coil voltage component to the N-th derivative of the current verses tube radii for a sample tube.

For illustration, the first few C coefficients versus tube radius were calculated for a particular example of compressing a tube. In this example, the inside radius of the workcoil is 20 mm, the outside radius of the workcoil is 30 mm, the tube (workpiece) has its maximum outside radius of 18 mm, and the inside radius of the tube is 17 mm. As the outside radius of the tube decreases, its inside radius is assumed to decrease in such a way that the amount of metal in the tube remains constant. The calculated dependencies of C(2), C(3), and C(4) are indicated in FIG. 3.

These coefficients, and therefore the voltage-current relationship, depend strongly on the tube radius and can be used to indicate the tube radius in a properly designed system. If the current pulse is sufficiently long, the N=2 term is the only one that is necessary and the application becomes particularly simple, requiring measurement of only the voltage, the current, and the first two derivatives of the current. For shorter current pulses, more terms are required in the series and more derivatives of the current must be measured to implement the technique.

The qualitative conclusions reached can be considered to be quite general, i.e. measurement of the coil current and voltage do allow monitoring the forming process. The relationship between voltage, current, and the part geometry is simple if the current pulse duration is in the correct range. This correct range is different for different materials and different geometries. The quantitative results presented in FIG. 3 are, of course, applicable only to the particular example considered here. In this example, rapid convergence of the series requires that $2\pi f$ (where f is the representative frequency of the driver current) must be less than 10000, which is the ratio of the magnitude of successive C coefficients. This implies that f must be less than 1591 Hz, or the current pulse duration must be greater that 628 $\mu$s.

Where part geometry differs or other factors are present, the mathematical approach described above may not apply. However, the approach described above can be made more broadly applicable by using an effective skin depth for the electromagnetic wave in the workpiece instead of the actual part thickness. This may involve a long numerical solution of the vector potential equation to predict the relationship between workpiece geometry and workcoil current and voltage. However this could be readily accomplished by programming of the computer means and would likely be justified for a production application.

The foregoing analysis addressed only the geometric changes occurring in the workpiece. The geometric changes represent a relatively large contribution to the measured signal. In addition, more subtle phenomena in the workpiece can be detected, such as cracking or phase change. A more sophisticated analysis is required to detect such phenomena because such physical changes will only provide small contributions to the working electromagnetic field making detection and interpretation difficult. To provide the level of resolution to sense such changes, test signals may be injected into the drive coil which are optimized for detecting specific physical conditions and which can be electronically separated from the primary working electromagnetic fields. These test signals would be provided to the workcoil 14 by a test signal generator 60 operating under the control of the monitoring and control means 16. Although these added test signals would not directly contribute to the electromagnetic forming process, the way in which the information is derived is the same, i.e. by recording the response by means of the sensing coil 18.

Once real time information about the condition of the workpiece being processed is available, the potential exists to actively control the process to obtain a product with known characteristics. To accomplish this, there is provided a switch 70 located in the connection between the power supply 16 and the workcoil 14, as shown in FIG. 1. The switch 70 is operated by switch controls 72 under the direction of the monitoring and control means 16. For the pulsed electromagnetic forming application discussed, typical ignition switching speeds for the capacitor banks which store the energy for deformation are generally 5 μs or less. This compares to a typical deformation cycle time of 100 μs, indicating that multiple capacitor banks could sequentially switched allowing additional current to be added to one or more driving coils at specific times in the deformation process. This would allow more energy to be added to the deformation process if needed or may permit more complex shapes to be formed with the use of multiple driving coils.

Shutting the process off once started can be complicated by the presence of the large inherent magnetic fields, velocity of the material being formed, and the fact that ignition switches in most practical terms only turn on (in other words, the switches can be closed very quickly but cannot be opened quickly). To accomplish the shutting off of the current to the workcoil 14, there can be provided a means to shunt the current being fed to the driver coil into a device to dissipate the remaining energy in the capacitor bank and magnetic field. Alternatively, one can provide a means to shunt the energy into another capacitor bank in order to conserve energy. In both cases the current to the driving coil is substantially reduced, slowing and eventually halting the process. Another alternative would be to alter or halt the deformation process by engaging secondary driving coils that oppose the initial deformation process to provide a balance of forces.

What is claimed is;

1. A process for electromagnetic forming of a workpiece comprising:

forming a workpiece with an electromagnetic force provided by a workcoil connected to a power supply, monitoring the current and voltage in the workcoil, deriving a real time the first several time derivatives of the current and voltage in the workcoil whereby a characteristic of the workpiece can be determined.

2. The process of claim 1 including the step of:

injecting test signals into the workcoil during the electromagnetic forming, and monitoring the response to the test signals in the workcoil whereby characteristics of the workpiece can be determined.

3. The process of claim 2 including the step of:

separating the response to the test signals injected into the workcoil before monitoring the test signals.

4. The process of claim 3 including the step of:

sensing the current and voltage in the workcoil by means of a sensing coil located in proximity to the workcoil.

5. The process of claim 4 including the step of:

controlling the electromagnetic forming process by a switch connecting the workcoil to the power supply, said step of controlling the process based upon a characteristic of the workpiece determined by the step of deriving the time derivatives of the current and voltage in the workcoil.

6. The process of claim 5 in which the step of controlling the electromagnetic process by a switch is further characterized by:

shunting current from the power supply to the workcoil into a device to dissipate the remaining energy.

7. The process of claim 5 in which the step of controlling the electromagnetic process by a switch is further characterized by:

shunting energy from the power supply into a capacitor bank.

8. A system for electromagnetic forming of a workpiece comprising:

a coil unit connected to a power supply, a monitoring and control means connected to the coil unit and capable of determining the voltage and current in the coil unit, said coil unit including a workcoil connected to a power supply and a sensing coil connected to the monitoring and control means, whereby the characteristics of a workpiece can be determined.

9. The system of claim 8 including:

a switch connecting said workcoil to the power supply, and switch control means connecting said monitoring and control means to said switch whereby said monitoring and control means can control application of power from the power supply to said workcoil.

10. The system of claim 9 including:

a test signal generator coupled to said workcoil, said test signal generator capable of injecting signals into said workcoil and further in which said monitoring and control means is capable of determining the quality and phase of a workpiece based upon the response of said workcoil to a signal from said test generator.

11. The system of claim 10 in which said monitoring and control means includes:

a peak detector coupled to said sensing coil, a phase detector coupled to said workcoil, a transient recorder coupled to said sensing coil and said workcoil, and a computer means coupled to the output of said peak detector, said phase detector, and said transient recorder, said computer means also connected to the power supply and said switch control means.

12. An improvement for a process for electromagnetic forming of a workpiece in which a workpiece is formed with an electromagnetic force provided by a workcoil connected to a power supply, the improvement comprising:

monitoring the current and voltage in the workcoil, and deriving in real time the first several time derivatives of the current and voltage in the workcoil, whereby a characteristic of the workpiece can be determined.

13. The improvement of claim 12 including the step of:

sensing the current and voltage in the workcoil by means of a sensing coil located in proximity to the workcoil.

14. The improvement of claim 13 including the step of:

injecting test signals into the workcoil during the electromagnetic forming, and monitoring the test signals in the workcoil whereby characteristics of the workpiece can be determined.

15. The improvement of claim 14 including the step of:

separating the test signals injected into the workcoil before monitoring the test signals.

16. The improvement of claim 15 including the step of:

controlling the electromagnetic forming process by a switch connecting the workcoil to the power supply, said step of controlling the process based upon a characteristic of the workpiece determined by the step of deriving the time derivatives of the current and voltage in the workcoil.

17. The improvement of claim 16 in which the step of controlling the electromagnetic process by a switch is further characterized by:

shunting current from the power supply to the workcoil into a device to dissipate the remaining energy.

18. The improvement of claim 17 in which the step of controlling the electromagnetic process by a switch is further characterized by:

shunting energy from the power supply into a storage media or capacitor bank.

* * * * *